US007207257B2

(12) United States Patent
Yu

(10) Patent No.: US 7,207,257 B2
(45) Date of Patent: Apr. 24, 2007

(54) AMMUNITION GUIDE

(75) Inventor: Dino K. Yu, Tustin, CA (US)

(73) Assignee: Meggitt Defense Systems, Inc., Irvine, CA (US)

( * ) Notice: Subject to any disclaimer, the term of this patent is extended or adjusted under 35 U.S.C. 154(b) by 123 days.

(21) Appl. No.: 11/075,220

(22) Filed: Mar. 8, 2005

(65) Prior Publication Data

US 2006/0201320 A1 Sep. 14, 2006

(51) Int. Cl.
*F41A 9/09* (2006.01)

(52) U.S. Cl. ..... 89/45

(58) Field of Classification Search ..... 89/45, 89/47; 42/25

See application file for complete search history.

(56) References Cited

U.S. PATENT DOCUMENTS

| | | | | |
|---|---|---|---|---|
| 341,371 | A | 5/1886 | Bruce | |
| 1,098,261 | A * | 5/1914 | Hermsdorf | 89/45 |
| 2,990,752 | A * | 7/1961 | Goodhne et al. | 89/47 |
| 3,218,930 | A * | 11/1965 | Girouard et al. | 89/45 |
| 4,380,950 | A | 4/1983 | Renoux | |
| 4,573,392 | A | 3/1986 | Mantel | |
| 4,677,894 | A | 7/1987 | Pongratz et al. | |
| 4,763,559 | A | 8/1988 | Bouillon | |
| 5,223,663 | A | 6/1993 | Bender-Zanoni et al. | |
| 5,305,679 | A | 4/1994 | Begneu | |
| 6,708,437 | B2 | 3/2004 | Murello | |
| 2004/0200110 | A1 | 10/2004 | Greenhut | |

* cited by examiner

*Primary Examiner*—Stephen M. Johnson
(74) *Attorney, Agent, or Firm*—Walter A. Hackler

(57) ABSTRACT

A guide for centering transit ammunition rounds generally includes a plate having an ammunition round passage port therethrough along with a plurality of spaced apart ammunition round contact members disposed around a circumference of the passage port. A plurality of moveable arms is provided with each arm supporting a respective member and enabling radial movement of the respective member to and from a passage port center. Each arm engages an adjacent arm preventing non-equidistance spacing of the member from the passage port center and a plurality of biasing elements may be provided and disposed in positions urging a respective arm and member toward the passage port center.

18 Claims, 4 Drawing Sheets

AMMUNITION GUIDE

The present invention is generally related to a device for improved ammunition round feeding in an automatic loading weapon system, is more particularly directed to an ammunition guide for centering transit ammunition rounds for smooth entry of the ammunition round into a firing chamber or transfer device.

With particular reference to vehicle mounted rapid-fire guns, it is important that the ammunition round is aligned with a firing chamber in order to prevent jamming.

This problem is particularly acute when the vehicle is underway and abrupt transverse forces are applied to a weapon loading system feeding the gun.

This problem is addressed in U.S. Pat. No. 4,677,899 for a device for the centering retention of ammunition in an ammunition receiver which utilizes spring elastic holding elements acting in a radially inward direction in order to center ammunition being charged in a cartridge chamber.

Such spring elastic holding elements are typically in the form of leaf type springs which may satisfactorily center the ammunition when not subjected to transverse forces. However, being resilient, such a spring elements also yield to transverse forces, thus improperly centering the ammunition rounds which may result in jamming of the ammunition loading system.

The present invention overcomes the disadvantages of the prior art and provides for an ammunition guide utilizing locking elements to reduce or minimize influence of any transverse forces on the centering of transit ammunition rounds.

SUMMARY OF THE INVENTION

A guide for centering transit ammunition rounds in accordance with the present invention generally includes a plate having an ammunition round passage port therethrough along with a plurality of spaced apart ammunition round contact members disposed around a circumference of the passage port.

A plurality of moveable arms are provided with each arm supporting a respective member and enabling radial movement of the respect member to and from a passage port center.

Each arm engages an adjacent arm which prevents non-equidistance spacing of the members from the passage port center and accordingly this engagement prevents influence or transient forces on the guiding of ammunition rounds by the ammunition round contact members.

Also in accordance with the present invention, a plurality of biasing elements may be disposed in positions for urging the respective arm and member toward the passage port center. These biasing elements, preferably springs, carry no significant load of the transient ammunition round, but rather urge the unloaded contact members toward the passage port center and transient ammunition round in order to provide initial contact therewith.

Preferably, in accordance with the present invention, the contact members are diabolo shaped rollers and each arm is pivotally mounted to the plate and includes first and second branches extending from the pivotal mount.

Each of the first branches of the arm support a respective roller which is rotatably attached thereto.

In addition, each of the first branch of the arms includes an extending finger which is engagable with a respective second branch of an adjacent arm, as hereinafter described in greater detail. This structure functions to enable centering of ammunition rounds without influence by transient transverse forces.

Preferably, the hereinabove noted biasing member is disposed between a fitting fixed to the plate and a respective first branch of a respective arm.

BRIEF DESCRIPTION OF THE DRAWINGS

The present invention may be more clearly understood with reference to the following detailed description in conjunction with the appended drawings, of which.

DETAILED DESCRIPTION

Figure 1:
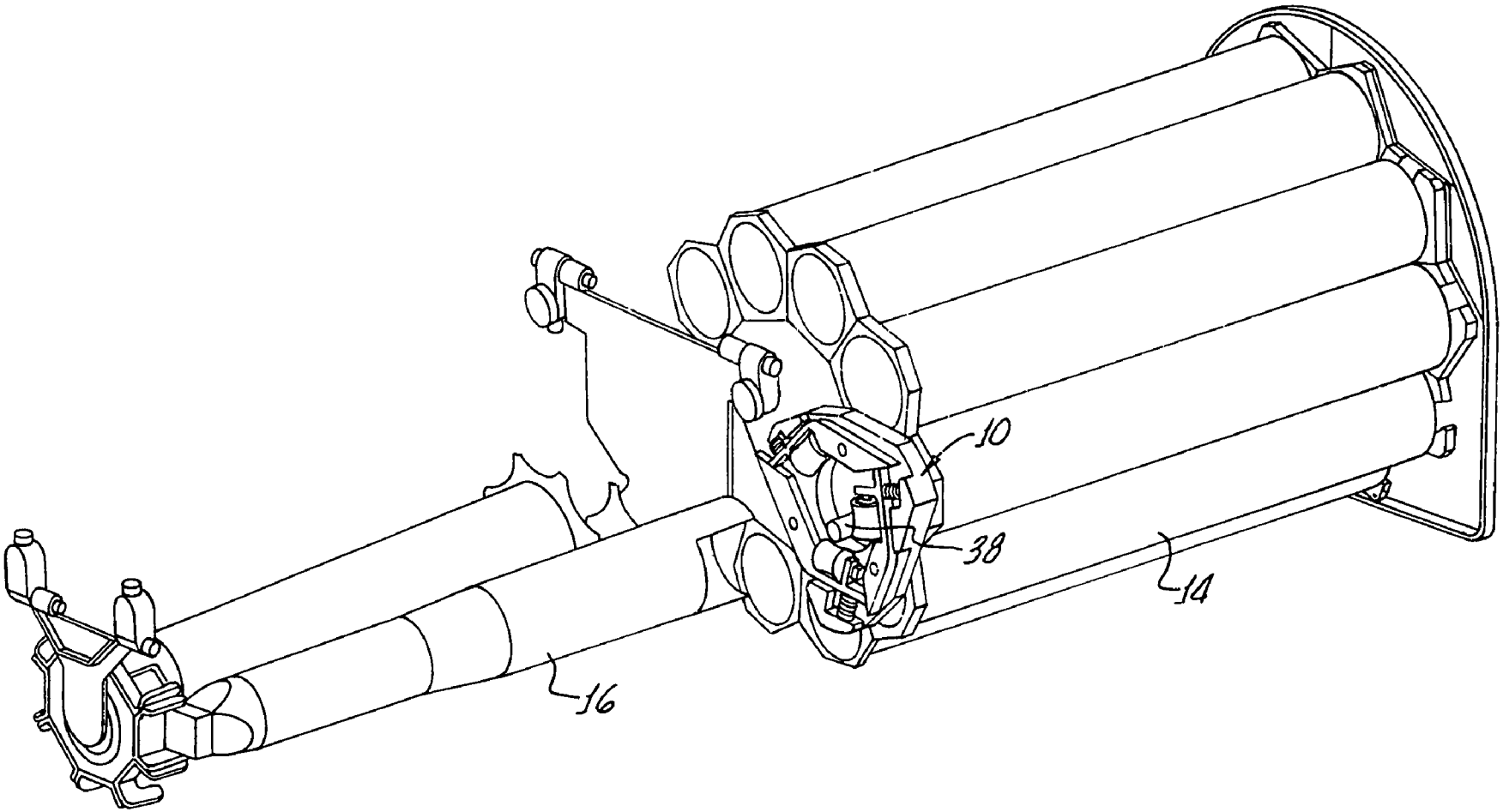
FIG. 1 is a perspective view of the guide in accordance with the present invention, as it may be installed between an ammunition magazine and a chamber.

With reference to FIG. 1, there is illustrated an ammunition guide 10 in accordance with the present invention as it may be disposed between an ammunition magazine 14 and a gun chamber representation 16 or other transfer mechanism, not shown, in accordance with the present invention. The ammunition magazine 14 and gun chamber 16 are not part of the present invention and accordingly not discussed in detail. Mounting of the ammunition guide may be of any conventional nature and, of course, dependent upon the magazine and gun configurations.

Figure 2:
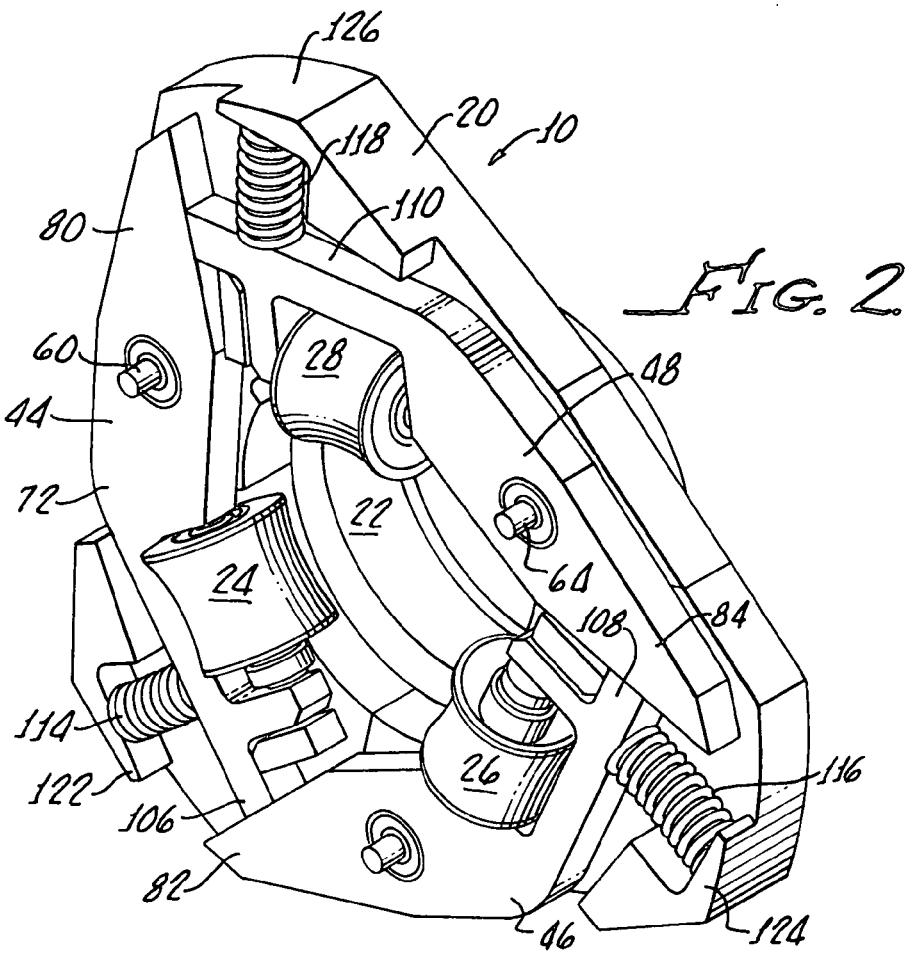
FIG. 2 is a perspective view of the guide in accordance with the present invention generally showing a plate having an ammunition round passage port therethrough with a plurality of spaced apart ammunition round contact members, a plurality of movable arms supporting the members pivotally attached to the plate.

With reference to FIG. 2, there is shown a perspective view of the ammunition guide 10 illustrated in FIG. 1 more particularly showing the guide including a plate 20 having a port 22 therethrough for the passage of ammunition rounds, as will be hereinafter described in greater detail.

A plurality of spaced apart ammunition round contact embers 24, 26, 28, preferably diabolo shaped rollers, are disposed around a circumference 32 of the port 22 for contacting and guiding an ammunition round, see FIGS. 2–8, as will be hereinafter described in greater detail.

While any suitable plurality of rollers 24, 26, 28 may be utilized, three are illustrated for demonstrating the effectiveness of the device for centering ammunition rounds 38 for entry into a gun chamber 16 or other transfer device, not shown.

Figure 3:
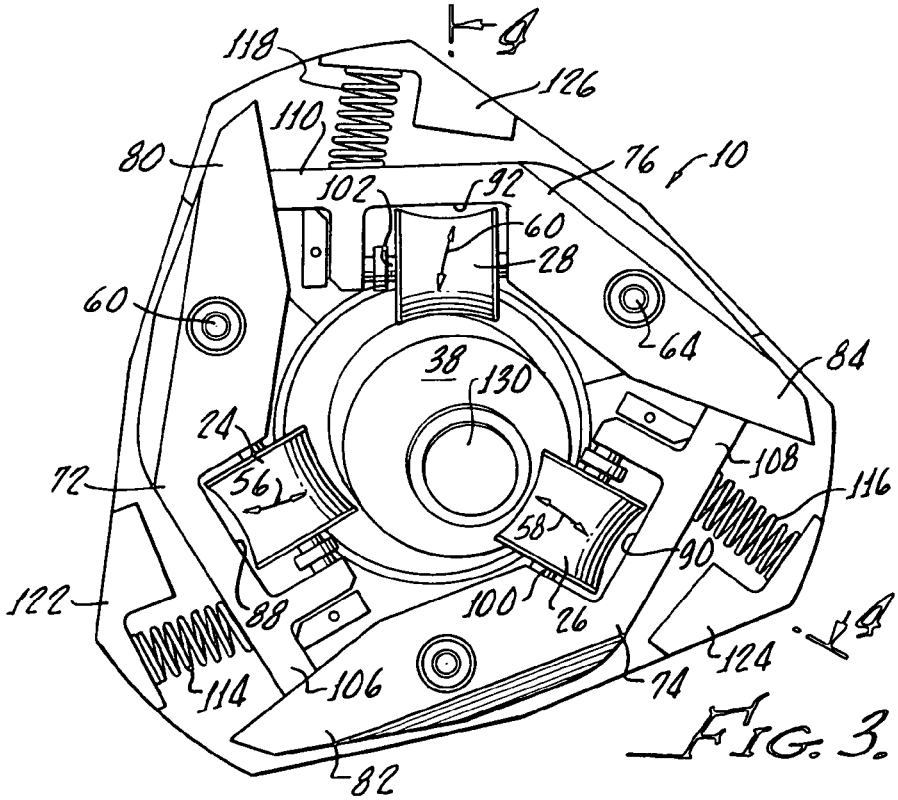
FIG. 3 is a plan view of the guide shown in FIG. 2 illustrating the initial entry of a transit ammunition round through the guide.

With reference again to FIG. 2, a guide 10 further includes a plurality of moveable arms 44, 46, 48 supporting a respective roller members 24, 26, 28 and enabling radial movement of the members 24, 26, 28 to and from a passage port center 54, as indicated by arrows 56, 58, 60 in FIG. 3. This movement is enabled by pivot 60, 62, 64 mounting of the arms 44, 46, 48 respectively to the plate 20, as illustrated in FIGS. 1 and 2.

Each arm 44, 46, 48 includes first branches 72, 74, 76 and second branches 80, 82, 84 disposed on opposite sides of pivots 60, 62, 64 respectively.

Each of the arm first branches 72, 74, 76 includes recesses 88, 90, 92 for receiving respective rollers 24, 26, 28 and rotatably mounting the rollers 24, 26, 28 by way of axes 98, 100, 102, and fingers 106, 108, 110 which engage respective adjacent arms 44, 46, 48 by way of a second branches 82, 84, 86 thus preventing non-equidistant spacing of the rollers 24, 26, 28 from the passage port center 54.

Biasing elements, for example, springs, 114, 116, 118 disposed between respective arms 44, 46, 48 between first branches 72, 74, 76 and fittings 122, 124, 126 fixed to the plate 20 urge a respective arms 44, 46, 48 and roller members 24, 26, 28 toward the passage port center 54.

Figure 4:
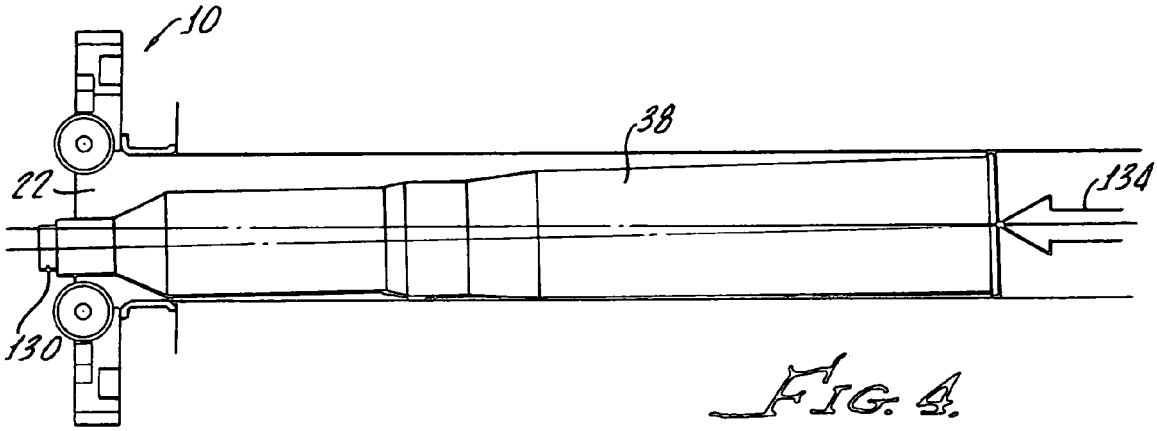
FIG. 4 is a cross sectional view of the guide and ammunition round disposed in an initial entry position taken along the line 4—4 of FIG. 3.

Operation of the guide is illustrated in FIGS. 3–8. FIGS. 3 and 4 illustrate a non-centered round entering the guide 10 through the port 22 with a nose 130 of the ammunition round 38 contacting the roller member 26. It should be appreciated that while the rollers are illustrated, the members 24, 26, 28 may be non-rotating support surfaces, this however provides increased frictional engagement with concomitant wear on the members 24, 26, 28.

After contact with the roller 26, further outward movement of the roller 26 is prevented by the engagement of the finger 106 with the second branch 82 of the arm 46. Thus, each arm 44, 46, 48 in effect engages an adjacent arm 44, 46, 48 preventing non-equidistant spacings of the members 24, 26, 28 from the passage port center 54.

Figure 6:
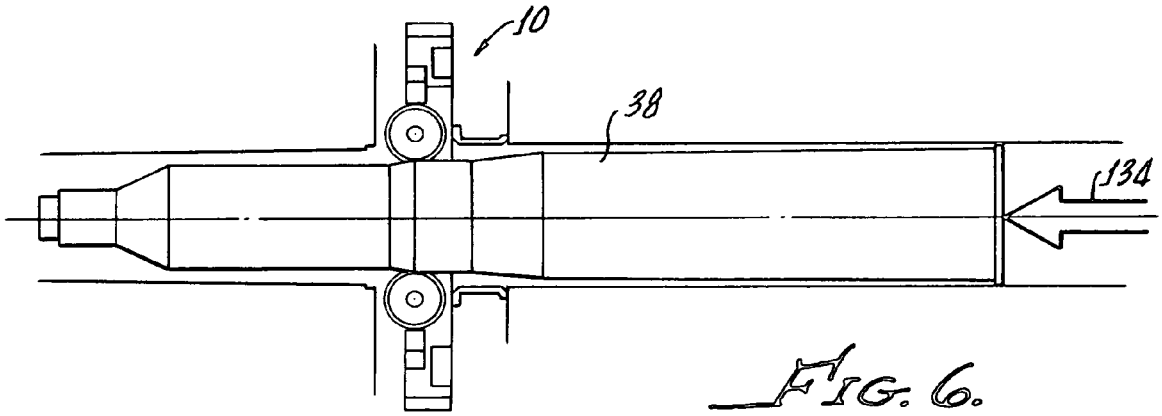
FIG. 6 is a cross sectional view of the guide and ammunition round shown in FIG. 5 taken along the line 6—6.
Figure 8:
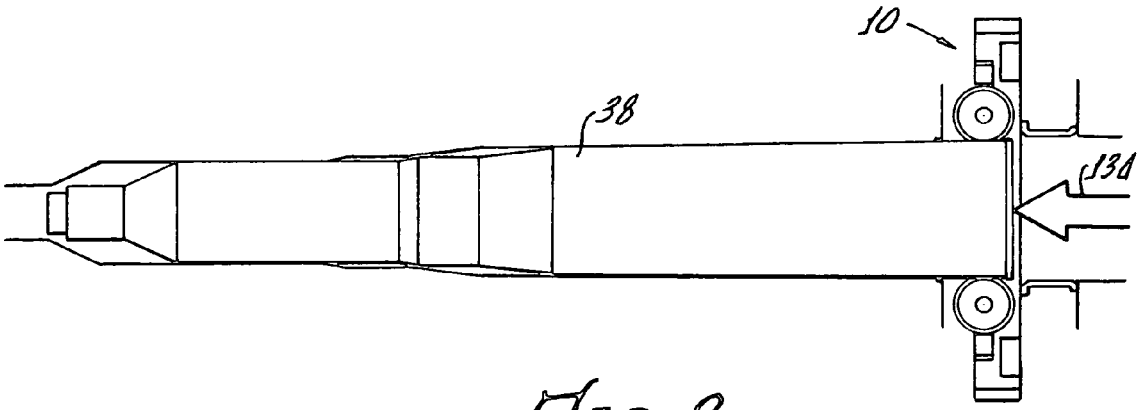
FIG. 8 is a cross sectional view of the ammunition round and guide taken along the line 8—8 of FIG. 7.
Figure 5:
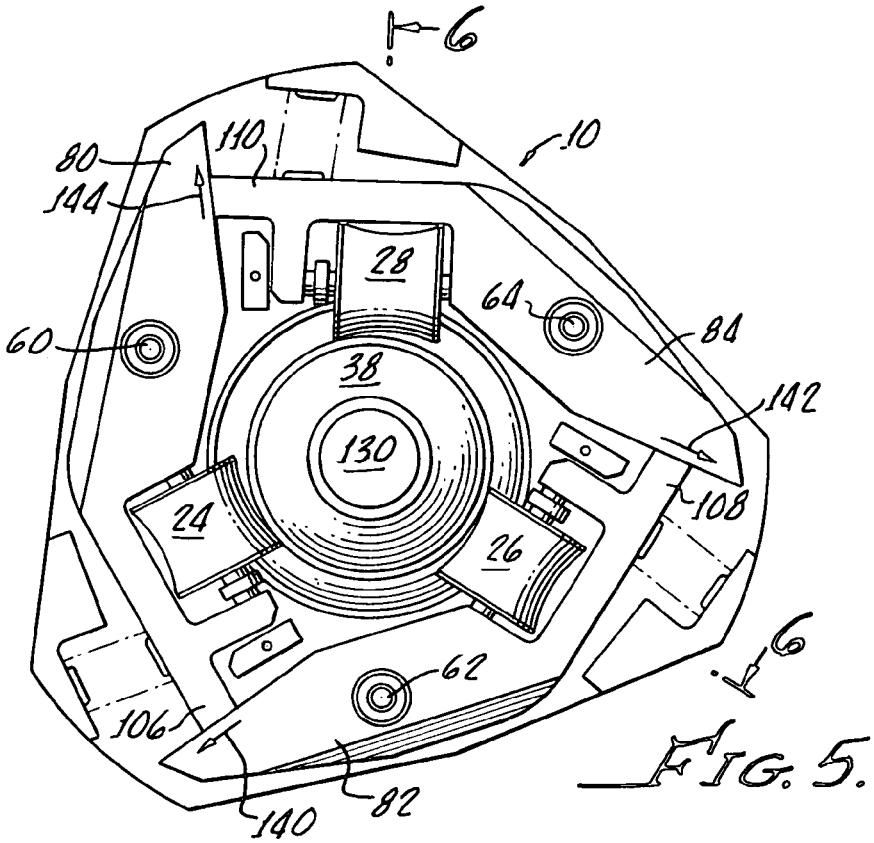
FIG. 5 is a view of the guide and ammunition round similar to that shown in FIG. 3 with the ammunition round being centered by the guide.

Continued longitudinal movement of the ammunition round 38, as indicated by the arrow 134 in FIGS. 4, 6, and 8 causes the centering of the round 138 within the port 28 and contact with all of the rollers 24, 26, 28, as illustrated in FIGS. 5 and 6.

Figure 7:
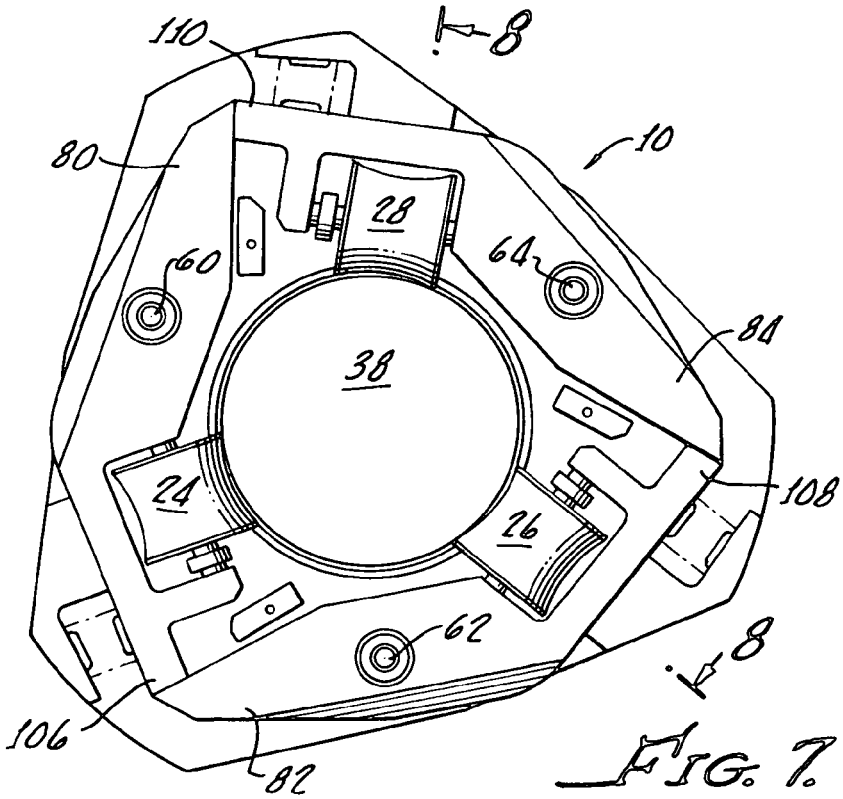
FIG. 7 is a view of the ammunition round completing its passage through the guide.

Continued outward movement of the rollers 24, 26, 28 is enabled by sliding of the fingers along the second branches 82, 84, 86, as indicated by the arrows 140, 142, 144 in FIG. 5 to a maximum opening as illustrated in FIG. 7 and FIG. 8.

Because of the locking action, hereinabove described, between the fingers 106, 108, 110 and the second branches 80, 82, 84 of the arms 44, 46, 48, small spring force creates a large centering force on the ammunition rounds 38 within the port 22. The springs 114, 116, 118 also function to return the arms 44, 46, 48 and roller 24, 26, 28 to their original position for receiving a subsequent transit ammunition round, not shown.

Although there has been hereinabove described a specific ammunition guide in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A guide for centering transit ammunition rounds, said guide comprising:

a plate having an ammunition round passage port therethrough;

three spaced apart ammunition round contact members disposed around a circumference of the passage port; and a plurality of moveable arms, each arm supporting a respective member and enabling radial movement of the respective member to and from a passage port center, each arm engaging an adjacent arm preventing non-equidistant spacing of the members from the passage port center.

2. The guide according to claim 1 further comprising a plurality of biasing elements disposed in positions urging a respective arm and member toward the passage port center.

3. The guide according to claim 1 wherein said member are diabolo shaped rollers.

4. The guide according to claim 1 wherein each arm is pivotally mounted to said plate and includes first and second branches extending from the pivotal mount.

5. The guide according to claim 4 wherein each first branch supports a respective member.

6. The guide according to claim 5 wherein the respective member is relatively attached to a respective first branch.

7. The guide according to claim 6 wherein said members are diabolo shaped rollers.

8. A guide for centering transit ammunition rounds, said guide comprising:

a plate having an ammunition round passage port therethrough;

a plurality of spaced apart ammunition round contact members disposed around a circumference of the passage port; and a plurality of moveable arms, each arm supporting a respective member and enabling radial movement of the respective member to and from a passage port center, each arm engaging an adjacent arm preventing non-equidistant spacing of the members from the passage port center, and each arm is pivotally mounted to said plate and includes first and second branches extending from the pivotal mount, each first branch supporting a respective member and includes an extending finger engagable with a respective second branch of an adjacent arm.

9. The guide according to claim 8 further comprising biasing members disposed between a fitting fixed to said plate and a respective first branch of a respective arm.

10. A guide for centering transit ammunition rounds, said guide comprising:

a plate having an ammunition round passage port therethrough;

at least three spaced apart rollers disposed around a circumference of the passage port; and at least three moveable arms, each arm supporting a respective roller and enabling radial movement to and from a passage port center, each arm engaging an adjacent arm preventing non-equidistant spacing of the rollers from the passage port center.

11. The guide according to claim 10 further comprising at least three springs disposed in portion urging a respective arm and roller toward the passage port center.

12. The guide according to claim 10 wherein said rollers are diabolo shaped.

13. The guide according to claim 10 wherein each arm is pivotally mounted to said plate and includes first and second branches extending from the pivotal mount.

14. The guide according to claim 13 wherein each first branch supports a respective roller.

15. The guide according to claim 14 wherein the respective roller is relatively attached to a respective first branch.

16. The guide according to claim 15 wherein said rollers are diabolo shaped.

17. The guide according to claim 16 wherein each first branch includes an extending finger engagable with a respective second branch of an adjacent arm.

18. The guide according to claim 17 further comprising springs disposed between a fitting fixed to said plate and a respective first branch of a respective arm.

* * * * *